United States Patent [19]

Maucher

[11] 4,135,563

[45] Jan. 23, 1979

[54] APPARATUS FOR REDUCING FIBER MATERIAL TO CHIP FORM

[76] Inventor: Walter H. Maucher, Rte. #2, Cantonment, Fla. 32533

[21] Appl. No.: 666,701

[22] Filed: Mar. 15, 1976

[51] Int. Cl.[2] ..... B27C 1/00

[52] U.S. Cl. ..... 144/323; 83/349; 83/356.2; 83/395; 83/658; 83/700; 144/162 R; 144/172; 241/28; 241/55; 241/222; 241/283; 241/294; 407/45

[58] Field of Search ..... 144/326 A, 326 B, 326 C, 144/162 R, 172, 174, 176, 218, 230, 180; 241/291, 28, 55, 222, 224, 227, 239, 241, 280, 292.1; 83/349, 356.2, 394, 395, 658, 698, 700

[56] References Cited

U.S. PATENT DOCUMENTS

| | | | |
|---|---|---|---|
| 1,906,486 | 5/1933 | Payzer | 144/176 UX |
| 2,130,457 | 9/1938 | Fickett et al. | 144/176 |
| 2,174,593 | 10/1939 | Pelot et al. | 144/176 X |
| 2,712,904 | 7/1955 | Durkee | 144/176 X |
| 2,825,371 | 3/1958 | Forman | 144/172 X |
| 2,889,861 | 6/1959 | Kolimbat | 144/230 X |
| 2,951,518 | 9/1960 | Cumpston, Jr. | 144/172 |
| 2,997,082 | 8/1961 | Schubert et al. | 144/172 X |
| 3,392,763 | 6/1968 | Ledergerber | 144/162 R X |
| 3,705,526 | 12/1972 | Bishop | 83/698 |

FOREIGN PATENT DOCUMENTS

| | | | |
|---|---|---|---|
| 744209 | 10/1966 | Canada | 144/230 |

*Primary Examiner*—Othell M. Simpson
*Assistant Examiner*—W. D. Bray
*Attorney, Agent, or Firm*—Bean, Kauffman & Bean

[57] ABSTRACT

An apparatus for reducing fiber material to chip form including an anvil assembly defining an anvil bearing surface of generally U-shaped configuration having leg portions joined by a connecting portion, at least one knife blade and carrier means for moving the knife blade in surface-to-surface bearing engagement with the anvil bearing surface in a direction extending from adjacent the ends of the leg portions towards the connecting portion to effect cutting or severing of the material into chip form.

49 Claims, 19 Drawing Figures

Fig. 1.
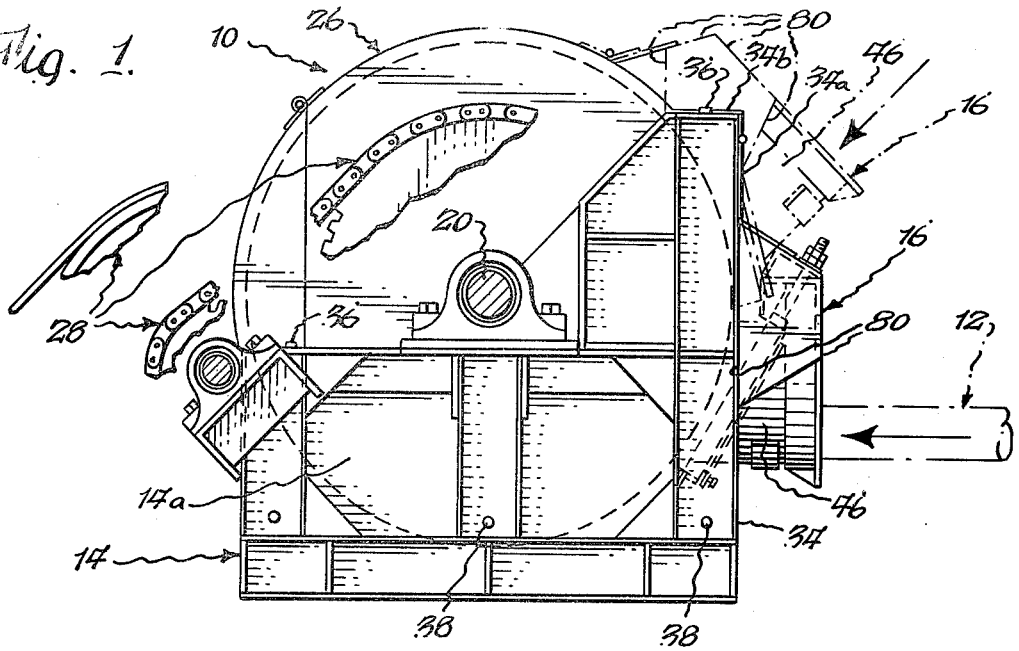
Fig. 2.
Fig. 3
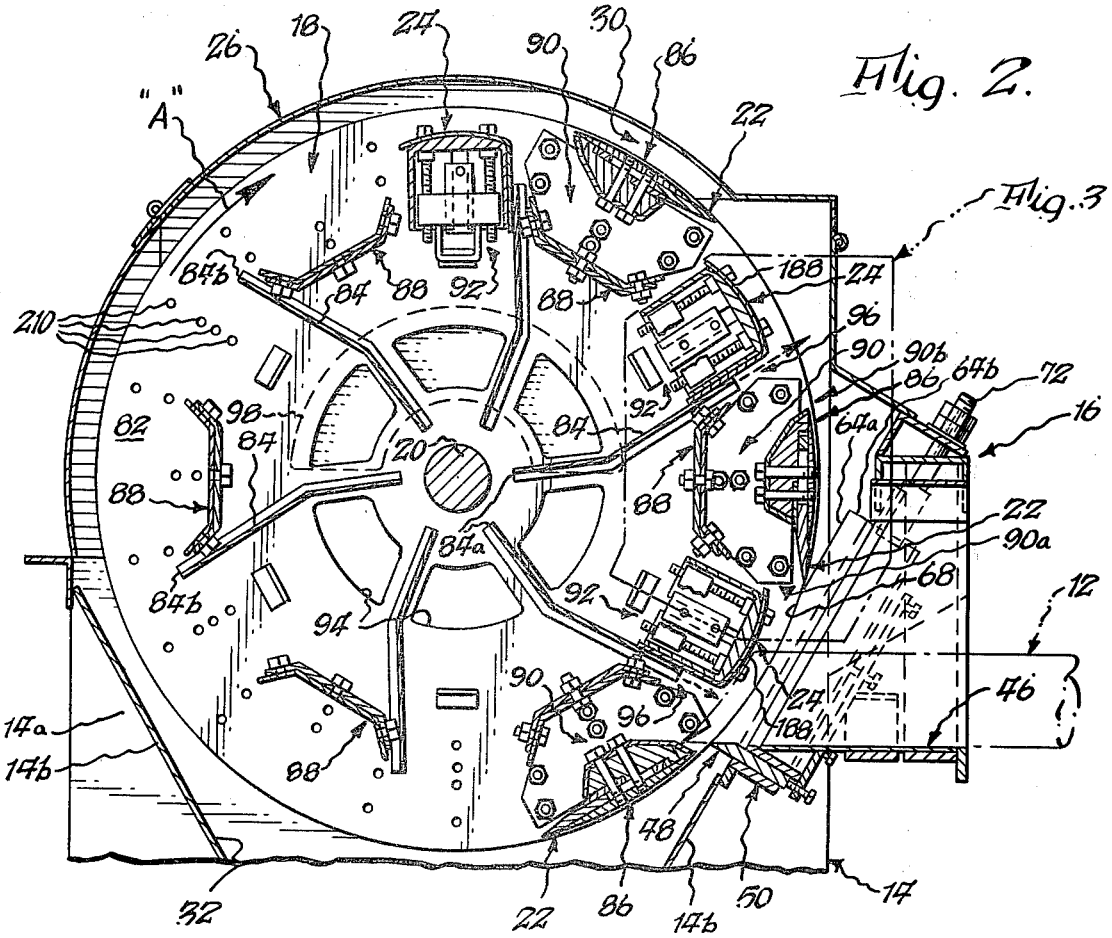

Fig. 8.
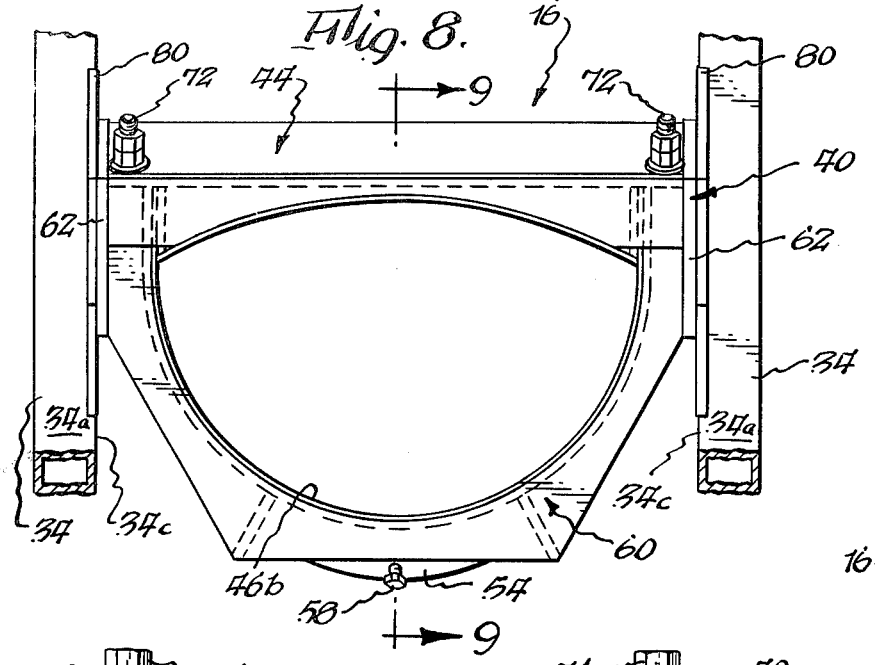
Fig. 9.
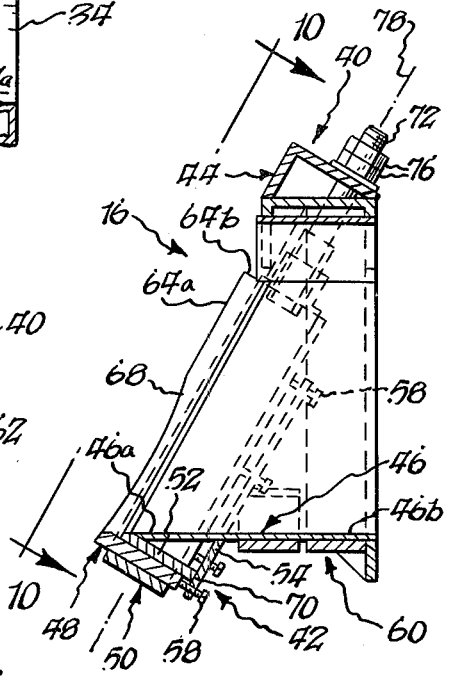
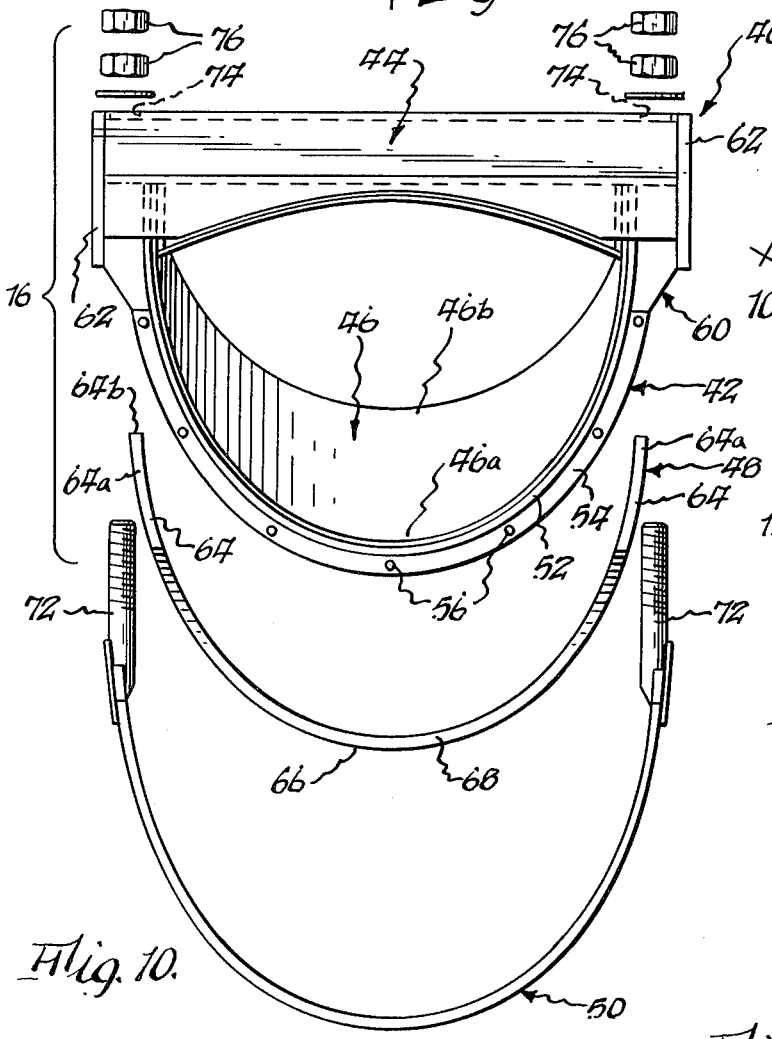
Fig. 10.
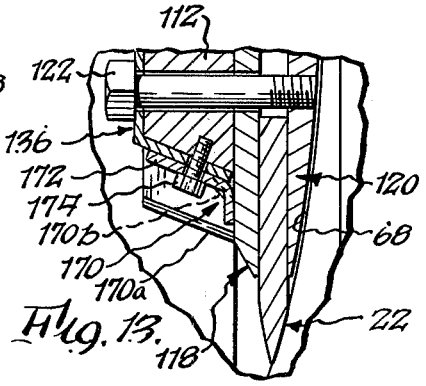
Fig. 13.
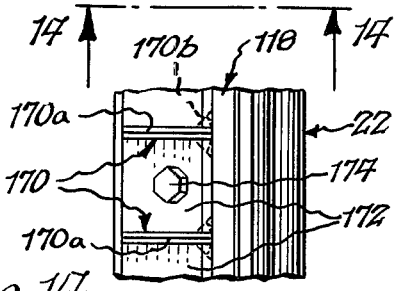
Fig. 14.

Fig. 11.
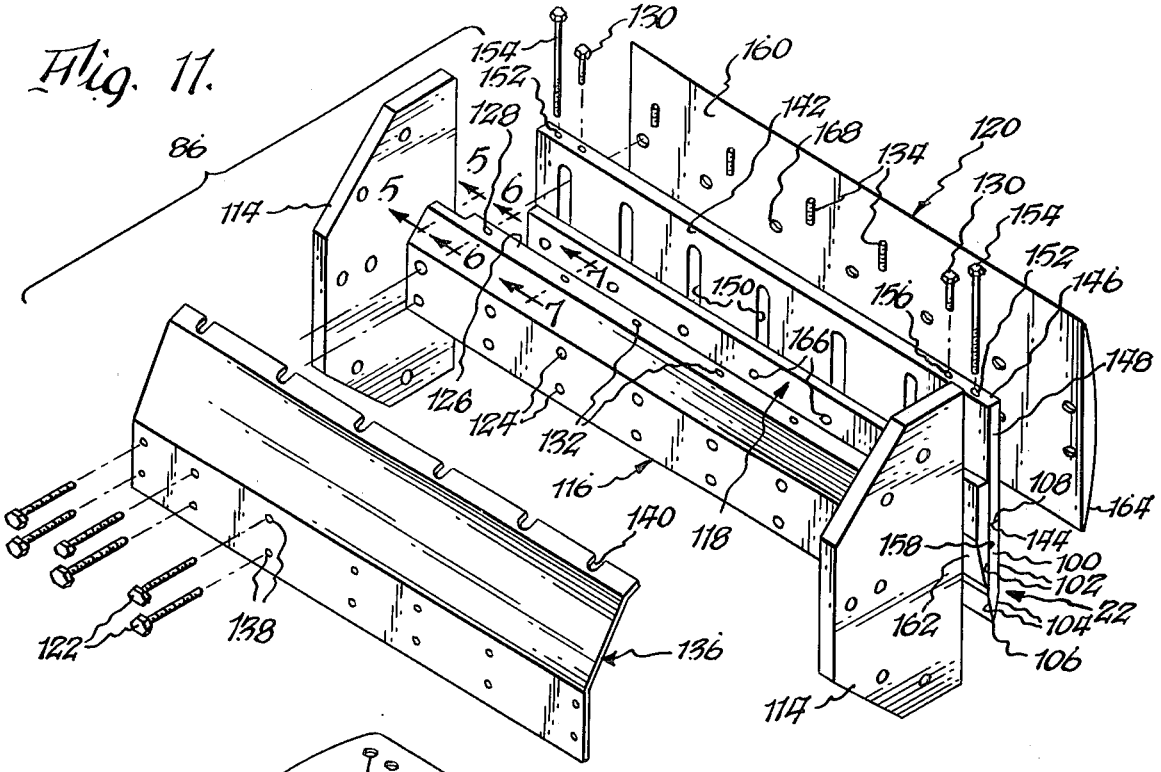
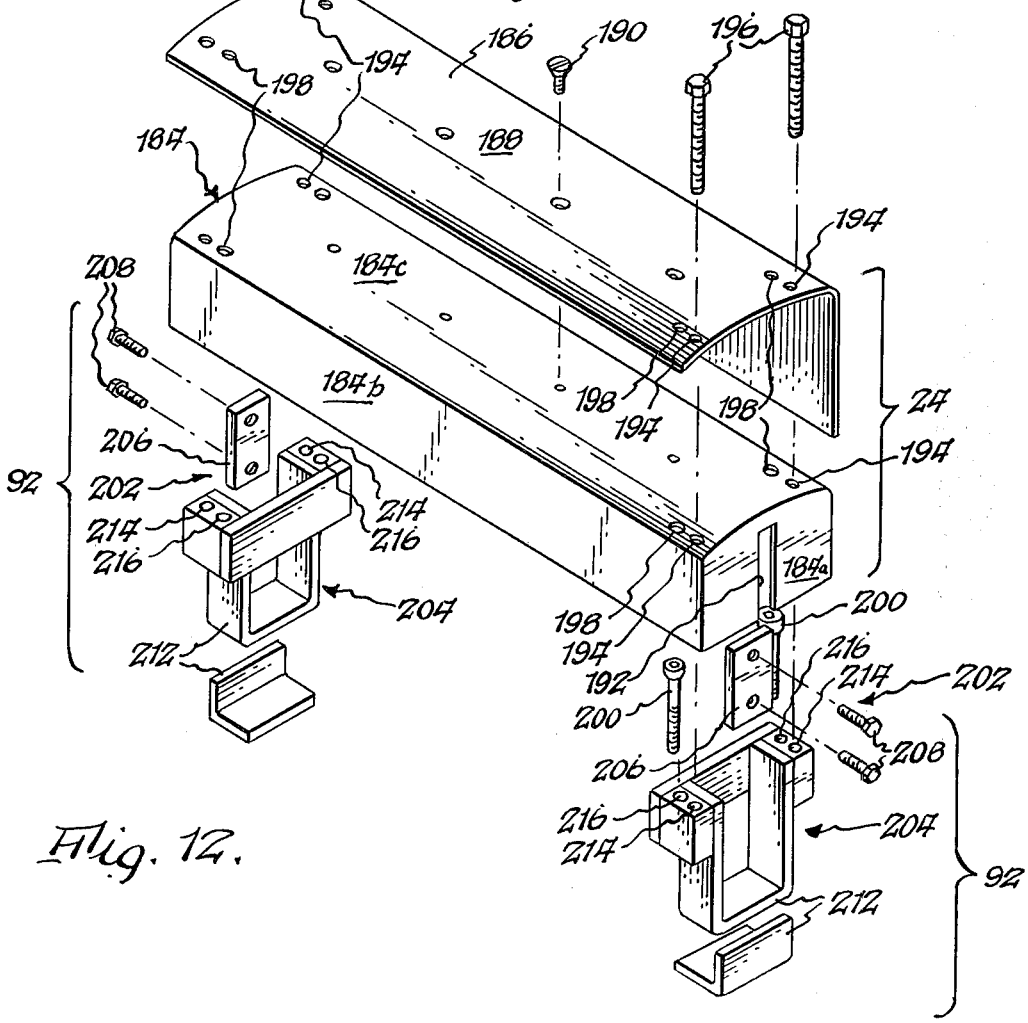
Fig. 12.

Fig. 15.
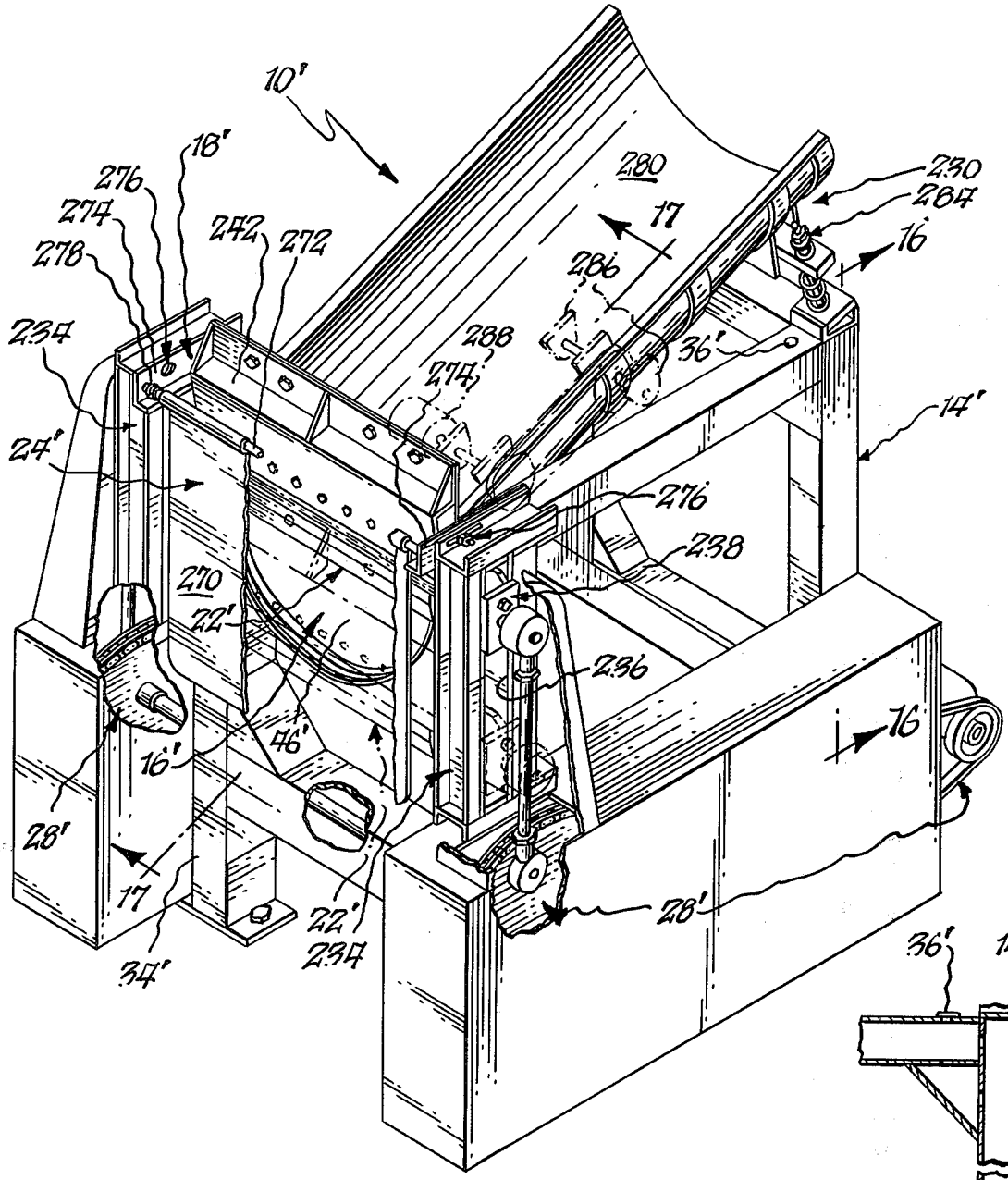
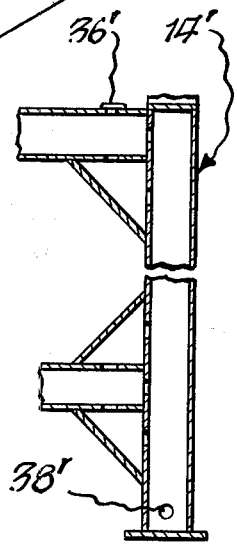
Fig. 16.

APPARATUS FOR REDUCING FIBER MATERIAL TO CHIP FORM

BACKGROUND OF THE INVENTION

Heretofore various machines have been devised for use in reducing fibrous material, such as wood, to chip form. However, to the best of my knowledge, these prior machines have suffered from one or more disadvantages including for instance the amount of physical labor normally required to mount/dismount/resharpen knife blades or other cutting elements employed in such machines; and the inability of such machines to be adjusted or the difficulty with which such machines may be adjusted to produce varying sizes of chips.

SUMMARY OF THE INVENTION

The present invention is directed towards an improved apparatus adapted to reduce fibrous material to chip form.

More particularly, the present invention is directed towards a machine featuring a novel knife blade-anvil arrangement, wherein one or more knife blades are adapted to pass in surface bearing engagement with an anvil bearing surface, during each chip severing operation. Engagement/close proximity of the knife blades with the anvil bearing surface provides for the sharpening and smoothing of the knife blades, and results in the work hardening of the steel from which the knife blades are formed. This arrangement also permits the knife blades to be formed with a minimum knife blade angle in order to enhance the severing operation, while at the same time permitting the knife edges of such blades to be relatively dull as compared to prior knife blades in order to minimize chipping or breakage of the knife blade during use. Further, the knife blades formed in accordance with the present invention may be reversed in order to alternately present their bearing surfaces for cooperation with the anvil bearing surface, and in this manner time consuming manual resharpening/reforming of the cutting edges of such knife blades is avoided.

More specifically, the material to be reduced is adapted to be fed across an anvil bearing surface characterized as being of a U-shaped configuration and arranged such that the knife blades pass in surface engagement therewith in a direction extending from adjacent its leg portions towards its leg connecting portion. As a result, a uniform pressure-force relationship is maintained between the knife blades and the anvil, during the severing operation, and the material is properly confined so as to insure uniformity of production of chips therefrom. Further, the anvil is oriented relative to the path of travel of the knife blades in order to provide for a maximum efficiency fiber cutting angle. Additionally, the construction of the anvil permits it to be selectively, positionally attached to the framework of the machine, as required to accommodate for the manner in which material is to be fed to the machine.

Another feature of the present machine is the provision of a stop device arranged in association with each knife blade for the purpose of controlling the length of chips severed by cooperation of such knife blade with the anvil. The stop device additionally assists in maintaining the knife blade in proper bearing relationship with the anvil bearing surface during the severing operation. Preferably, the stop device is mounted for adjustment in order to provide for selectively varying the size of chip formed by the operation of the present machine.

Two forms of the present machine will be described in detail. In a first form, a plurality of knife blades and stop devices are mounted for rotation about a common axis and the anvil bearing surface is concave in order to conform to the contour of the path of travel of the knife blades. This form of the machine is particularly adapted for high volume production of chips; has the capability of producing the full size range of commercially desirable chips; incorporates features insuring non-clogging passage of chips through and discharged from the machine; and includes removable and expendable wear plates for protecting permanent parts of the machine which would otherwise be subjected to severe abrasion.

In a second form of the present machine, a single knife blade is supported for vertically directed reciprocating movements in association with a generally planar anvil bearing surface. This form of the machine is primarily intended to provide a relatively low cost machine intended for use in installations having relatively low output requirements of chips falling within the medium and large size ranges of commercially desirable chips. Alternatively, if desired, this form of the machine may be employed to provide an output of relatively long lengths of material, such as would be sized for use in a fireplace.

DRAWINGS

The nature and mode of operation of the present invention will now be more fully described in the following detailed description taken with the accompanying drawings wherein:

FIG. 1 is a side elevational view of an apparatus formed in accordance with the present invention with parts broken away for purposes of clarity;

FIG. 2 is a vertical sectional view showing the interior of the apparatus shown in FIG. 1 and with parts broken away for purposes of clarity;

FIG. 8 is an elevational view showing the inlet end of the anvil assembly provided in the apparatus shown in FIG. 1;

FIG. 9 is a sectional view taken generally along the line 9—9 in FIG. 8;

FIG. 10 is an exploded view of the anvil assembly as viewed in the direction designated as 10—10 in FIG. 9;

FIG. 11 is an exploded perspective view of a knife blade and its associated mounting assembly;

FIG. 12 is an exploded perspective view of the stop plate and its associated mounting assembly;

FIG. 14 is a fragmentary view as viewed generally along the line 14—14 in FIG. 13;

FIG. 15 is a right front perspective view showing an alternative form of the apparatus shown in FIG. 1;

FIG. 16 is a fragmentary sectional view taken generally along the line 16—16 in FIG. 15;

DETAILED DESCRIPTION

Figures 3, 4, 5, 6, 7, 13:
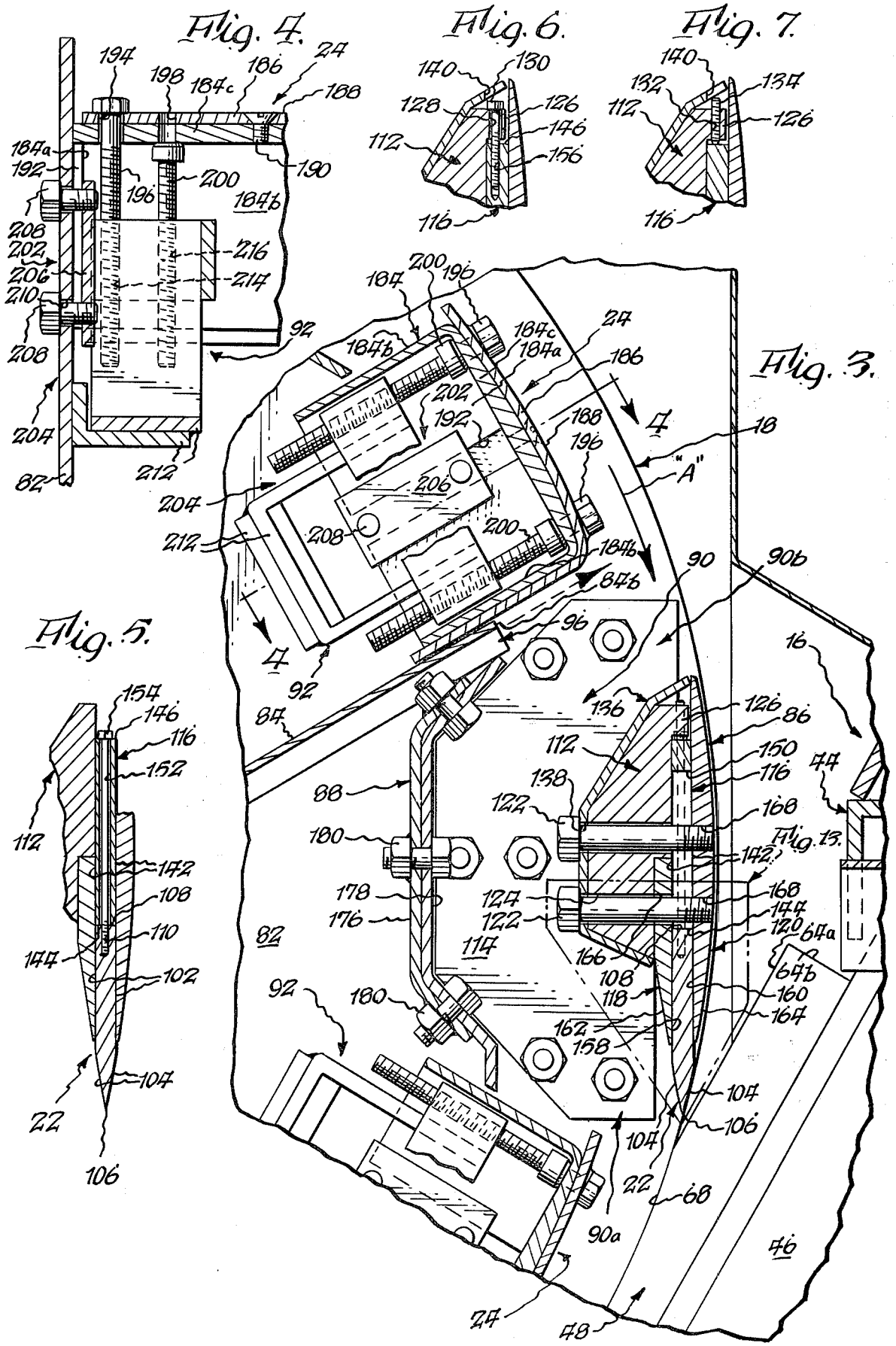
FIG. 3 is an enlarged view of the area generally designated as FIG. 3 in FIG. 2.
FIG. 4 is a sectional view taken generally along the line 4—4 in FIG. 3.
FIGS. 5, 6 and 7 are fragmentary sectional views taken generally along like numbered lines in FIG. 11.
FIG. 13 is a fragmentary view showing a modification of the construction generally enclosed by the line designated as FIG. 13 in FIG. 3.

Reference is now made to FIG. 1, wherein a machine formed in accordance with the present invention is designated as 10 and shown as being adapted for use in reducing fibrous material 12 to chip form. Machine 10 is shown in FIGS. 1 and 2 as generally including a machine base or framework 14; an anvil assembly 16, which is rigidly secured to machine base 14; a rotor or carrier assembly 18, which is supported on machine base 14 for rotation about a horizontally disposed axis by a drive shaft 20 and serves to support or mount a plurality of knife blades 22 and a plurality of stop devices 24 for movement along circular paths of travel in a direction indicated by arrows "A" in FIGS. 2 and 3 past anvil assembly 16 for effecting reduction of material 12 to chip form; a suitable casing 26, which is operable in conjunction with machine base 14 to form an enclosure for rotor assembly 18; and a suitable drive arrangement 28, which is positionally fixed relative to machine base 14 and employed to effect driven rotations of drive shaft 20.

While machine 10 is primarily intended for use in reducing wood products in the form of logs, limbs, slab lumber, planks, waste lumber and bark to chip form, it may of course be employed to reduce other fibrous material to desired length. Also, it will be understood that the term "chip," as used herein, is intended only to designate the severed length of fibrous material regardless of actual size, which results from operation of machine 10 and/or the alternate form of such machine, which is generally designated as 10' and hereinafter discussed with reference to FIGS. 15–19.

Now referring particularly to FIGS. 1, 2 and 8, it will be understood that machine base 14 is of beam and plate construction and includes side and end portions 14*a* and 14*b*, respectively, which cooperate with cover 26 to define a rotor assembly receiving chamber 30 having a downwardly opening chip discharge or outlet 32. In a preferred form of the invention best shown in FIGS. 1 and 8, machine base 14 includes a pair of essentially parallel and vertically extending standards 34, which define mounting surfaces 34*a* and 34*b* arranged essentially parallel to the axis of shaft 20 and facing guide surfaces 34*c*. Also, standards 34, as well as the other beam members employed in forming machine base 14, are preferably hollow in order to receive a flowable ballast, such as sand, which may be supplied to and withdraw from the beam members via inlet and outlet openings normally blocked by removable plugs 36 and 38, respectively. The cavities of adjacent beam members would preferably be arranged in flow communication, best shown in FIG. 16 in connection with machine 10'. This mode of construction greatly reduces the as-fabricated and shipping weight of machine 10, while permitting the installed or operating weight of the machine to be increased. Moreover, by employing sand or like granular material as ballast, machine vibration is reduced and operating noise is damped.

Anvil assembly 16 is best shown in FIGS. 8, 9 and 10 as including a main frame 40 having a generally U-shaped lower portion 42 and an upper mounting portion 44 arranged to bridge across the upper ends of lower portion 42; a generally U-shaped guide chute 46; a generally U-shaped anvil bar 48; and a generally U-shaped clamping strap or member 50.

In the illustrated form of the invention lower portion 42 includes a clamping plate 52 and an adjustment plate 54, which is formed with a plurality of spaced threaded openings 56 adapted to receive adjustment screw devices 58. Chute 46 has an outlet end 46*a*, which is arranged within lower portion 42 and weld affixed to plates 52 and 54, and an inlet end 46*b*, which is braced by a generally U-shaped bracket device 60. Bracket device 60 has its upper ends fixed to main frame portions 42 and 44, and the resultant or composite frame construction is preferably braced by a pair of weld affixed end plates 62.

Anvil bar 48 is preferably formed of tool steel and shaped to define a pair of leg portions 64 and a connecting portion 66, which are shaped to conform essentially to the contour of clamping plate 52 and cooperate to define forwardly facing anvil bearing and rearwardly facing adjustment bearing edge surfaces 68 and 70, respectively. The term "U-shaped", as used herein, is not meant to be limited to the illustrated, smoothly curved configuration of anvil bar 48 and adjacent parts of anvil assembly 16. Rather, this term is means to imply that these parts of anvil assembly 16 are shaped to define a recess whose surfaces may be either smoothly curved or generally flat, such as would be the case if the recess were to be of a squared or V-shaped configuration.

In the form of the invention presently being discussed, the configuration of bearing surface 68 is arcuately concave and conforms to the contour of the path of travel of knife blades 22 about the axis of shaft 20. Also, it will be appreciated from viewing FIGS. 2 and 9, that leg portions 64 serve to define clearance or guide surfaces 64*a*, which are disposed in a coplanar relationship and arranged at an obtuse angle equal to, but normally slightly greater than 180° relative to the upper end of bearing surface 68 and end surfaces 64*b*. The arrangement of clearance surfaces 64*a*, relative to anvil bearing surface 68 serves to guide the knife blades into engagement with the anvil bearing surfaces when the latter is disposed slightly inwardly of the path of knife blade travel, as a result of machine vibration or anvil bar adjustment. Further, clearance surfaces 64*a* serve to accommodate for "growth" in the size of anvil bearing surface 68, as anvil bar 48 is "consumed" in the manner to be described.

Clamping strap 50 is adapted to be removable fixed to upper mounting portion 44 for the purpose of releasably clamping anvil bar 48 against clamping plate 52 in the manner best shown in FIG. 9, by means of a pair of threaded bolts 72, which are weld affixed to the ends of clamping strap 50 and sized to removably pass through upper mounting portion openings 74 for connection with clamping nuts 76. When the several parts of anvil assembly 16 are assembled in the manner described above, a common plane, designated as 78 in FIG. 9, passes through clamping plate 52, anvil bar 48 and clamping strap 50, such common plane being disposed essentially parallel to anvil bar bearing adjustment surface 70 and forming an acute angle of approximately 30° with guide chute 46.

As indicated above, anvil bearing surface 68 is subject to being worn away during operation of machine 10, due to surface-to-surface engagement with knife blades 22. Thus, it is necessary to periodically adjust the position of anvil bar 48 in order to move anvil bearing surface 68 in a direction normal to plane 78 and towards the path of travel of such knife blades. This is accomplished by loosening nuts 76 to remove clamping strap 50 pressure from anvil bar 48, turning adjustment screw devices 58 through an essentially common member of turns or partial turns and finally tightening nuts 76 to again clamp the anvil bar against clamping plate 52. Periodic adjustments may continue until the spacing between anvil bar edge surfaces 68 and 70 is reduced to some design limit and/or clearance surfaces 64*a* are worn away or consumed by the expansion of anvil bearing surface 68 to a point at which knife blades would "catch on" or engage with end surfaces 64*b*.

By referring to FIG. 1, it will be understood that the positioning of anvil assembly 16 relative to machine base 14 will depend upon the nature of material 12 and the manner in which it is to be fed or supplied to machine 10. Thus, for instance, when material 12 is heavy and of substantial length, as would be in the case of a log, anvil assembly 16 would normally be arranged in its full line position shown in FIG. 1, wherein guide chute 46 is horizontally disposed for alignment with a conventional powered conveyor, not shown. For installations where machine 10 is intended to reduce relatively short lengths of fbirous material conveniently fed to the machine such as by means by gravity or a vibratory feed trough of the type shown in FIGS. 15 and 17, anvil assembly 16 would be positioned to arrange guide chute 46 at an angle relative to the horizontal, such as is shown for instance in broken line in FIG. 1.

Rotor assembly 18 generally includes a pair of parallel end plates 82, which are rigidly fixed to shaft 20 to extend radially thereof; a plurality of stiffener-fan blade elements 84, which extend generally radially of shaft 20 and have their opposite end marginal edges fixed to end plates 82; a plurality of knife blade supporting or clamping assemblies 86; which are opposite end supported on end plates 82 and extend parallel to shaft 20; a plurality of stiffener-wear plate assemblies 88, which are opposite end supported on end plates 82 to extend essentially parallel to shaft 20 and are disposed one radially inwardly of each of assemblies 86 to cooperate therewith to define chip flow passageways 90 having generally radially outwardly opening inlet and outlet ends 90*a* and 90*b*, respectively; and a plurality of pairs of stop device support assemblies 92, which are fixed in alignment to facing surfaces of end plates 82.

One or both of end plates 82 may be formed with a plurality of annularly spaced air inlet openings 94, through which air may be drawn into the interior of rotor assembly 18 by operation of blade elements 84. Blade elements 84 are best shown in FIG. 2 as having a radially inner marginal edges 84*a* terminating adjacent shaft 20 and intermediate adjacent ones of openings 94; and as having radially outer marginal edges 84*b*, which terminate intermediate one of assemblies 88 and a trailing one of stop devices 24 in the direction of rotation of rotor assembly 18 and cooperate with such one of assemblies 88 to define an air jet nozzle 96 fed with air drawn through openings 94. Each of nozzles 96 extend essentially between end plates 82 and serve to provide a radially outwardly directed jet arranged adjacent the outlet end 90*b* of chip flow passageway 90. This air jet assists in drawing severed chips through its associated flow passageway 90 and subsequent discharge of such chips through outlet 32. It is believed desirable to interrupt operation of the air jets for that period of time during which chips are not being cut and discharged from machine 10, and to this end a baffle plate 98 may be carried on casing 26 in close proximity to the outer surface of the end plate 82 in which openings 94 are formed. Ambient air may be variously supplied to chamber 30 for admission to openings 94, as by forming one or more breather openings, not shown, in casing 26.

Knife blades 22 are best shown in FIGS. 3, 5 and 11 as being bounded by opposite and normally parallel end surfaces 100; a pair of parallel clamping surfaces 102, which are of rectangular configuration having opposite end marginal edges joined to end surfaces 100 and parallel leading and trailing marginal edges relative to the direction of rotation of rotor assembly 18; a pair of bearing surfaces 104, which extend between end surfaces 100 and preferably uniformly converge one from adjacent each clamping surface leading edge to define a knife edge 106; and a bearing surface 108, which extends between end surfaces 100 and is joined in a right angular relationship to the trailing marginal edges of clamping surfaces 102. Bearing surfaces 104 may be of planar configuration, but are preferably ground to assume a convex configuration, which essentially conforms to the path of travel of the knife blades and more particularly the path of travel of knife edge 106. In either event, the blade angle defined by surfaces 104 will preferably be between about 20° and 30°. In the preferred form of knife blade 22, a pair of parallel threaded openings 110 are arranged to open through bearing surface 108 one adjacent each of end surfaces 100; openings 110 being arranged within a plane arranged essentially equidistant from clamping surfaces 102. Further, the knife blades are preferably formed of tool steel.

Knife blade clamping assemblies 86 are best shown in FIGS. 3 and 11 as generally including a carrier member 112, which is arranged parallel to shaft 20 and has its opposite ends fixed to end plates 82 via support plate 114; an adjustment plate 116; an inner clamping plate 118; outer clamping plate 120; and threaded bolt devices 122 for releasably clamping knife blade 22, carrier member 112, adjustment plate 114, inner clamping plate 118 and outer clamping plate 120 in their assembled condition shown in FIG. 3.

Carrier member 112 may be built up from a plurality of pieces of flat stock material or machined from a single piece of steel, as indicated in the drawings, and if desired, the carrier member may be formed integrally with or weld affixed to inner clamping plate 118. Again referring to FIGS. 3 and 11, it will be seen that carrier member 112 is formed with a plurality of parallel through bore openings 124, which extend in a direction generally radially of the axis of shaft 20 and are dimensioned to loosely receive bolt devices 122, and a trailing edge ledge or flange portion 126. Ledge 126 is best shown in FIGS. 5 and 11 as having its opposite ends cut away, or spaced inwardly from support plates 114; in FIGS. 6 and 11 as having a pair of bore openings 128, which are dimensioned to loosely receive a pair of threaded return bolts 130 and arranged one adjacent each end of the ledge; and in FIGS. 7 and 11 as having a plurality of threaded openings 132, which are dimensioned to threadably receive adjustment or set screw devices 134 and arranged in a relatively uniformly spaced relationship intermediate bore openings 128. The radially inner surface of carrier member 112, which serves to radially outwardly bound passageway 90, would preferably be protected by a removable wear plate 136. Wear plate 136 is formed with through bore openings 138 dimensioned to loosely receive bolt devices 122 and with trailing edge slots 140 to afford access to openings 128 and 132.

Adjustment plate 116 is of parallelepiped configuration bounded by a pair of clamping surfaces 142, a front bearing surface 144, a rear adjustment surface 146 and a pair of end surfaces 148. Adjustment plate 116 is shown in FIGS. 3 and 11 as being formed with a plurality of parallel slots 150, which are sized to slidably receive bolt devices 122 and arranged to open through surfaces 142 and 144; in FIGS. 5 and 11 as having a pair of bore openings 152, which extend between surfaces 144 and 146 and are sized to receive a pair of connecting bolt devices 154; and in FIGS. 6 and 11 as having a pair of threaded openings 156, which extend through rear surface 146 and are sized to threadably receive return bolt devices 130.

Inner and outer clamping plates 118 and 120 are characterized as having facing clamping surfaces 158 and 160 and clearance surfaces 162 and 164, which diverge outwardly and in a trailing direction relative to leading marginal edges of clamping surfaces 158 and 160, respectively. The included angles defined by surfaces 158 and 162 and by surfaces 160 and 164 corresponds essentially to one-half the included angle defined by knife blade bearing surfaces 104. More particularly, inner clamping plate 118 is formed with a plurality of through bore openings 166, which are dimensioned to freely receive bolt devices 122, and outer clamping member 120 is formed with a plurality of threaded openings 168 dimensioned to threadable receive such bolt devices. Outer clamping plate 120 is preferably formed to extend between leading and trailing edges of the knife blade supporting assembly and has its radially outer surface shaped to essentially conform to the contour of the path of travel of knife blades 22. Alternatively, the outer clamping plate may be of multi-part construction having a leading clamping plate portion of a size approximating that of inner clamping member 118 and a trailing or filler portion.

By again referring to FIG. 3, it will be understood that knife blade 22 is removably fixed for movement with adjustment plate 116 with their surfaces 108 and 144 disposed in aligned abutting engagement by means of connecting bolt devices 154, whereas adjustment plate 116 is in turn adjustably connected to ledge portion 126 of mounting member 112 for extending or forwardly directed movements under the control of screw devices 134 and for retracting or rearwardly directed movements under the control of return bolts 130. Bolt devices 122 serve when tightened to maintain clamping plate surfaces 158 and 160 in lapping clamping engagement with clamping surfaces 102 and 142 and to maintain knife blade 22, adjustment plate 116, inner clamping plate 118 and outer clamping plate 120 positionally fixed relative to carrier member 112; and when loosened to cooperate with adjustment member slos 150 to maintain knife edge 106 parallel to the axis of drive shaft 20 during adjustments of adjustment plate 116 and thus knife blade 22. It will also be understood that the construction of knife blade 22 and its mode of attachment to adjustment plate 116 permits the knife blade to be releasably clamped to supporting assembly 86 in order to selectively and alternatively position its bearing surfaces 104 for engagement with anvil bearing surface 68, as required to compensate for wearing away and/or deformation of cutting edge 106.

It will be appreciated that in an apparatus of the type thus far described, a single chip is severed from the leading end surface of material 12, during each passage of a knife blade 22 in cooperation with anvil bar 48. For many woods, this single chip readily falls apart or disintegrates into a plurality of small chips incident to the severing operation, during passage through passageway 90 and/or during discharge from machine 10. However, chips severed from certain woods do not readily disintegrate, and thus when machine 10 is intended to be employed in reducing these woods, the machine would preferably be provided with additional cutting or chip size reducing elements 170 arranged to project transversely within passageway 90, as shown in FIGS. 13 and 14. In a preferred construction, cutting elements 170 are in the form of flat plates, which are shaped to define a cutting edge 170*a* extending along one marginal edge thereof and a mounting enlargement 170*b* arranged remotely from cutting edge 170*a* and to project from oppositely facing flat surfaces thereof. Cutting elements 170 are shown as being maintained in a parallel spaced relationship and removably fixed in position within passageway 90 by a plurality of clip members 172, which positionally engage flat surfaces of adjacent cutting elements 170 in overlying clamping engagement within enlargements 170*b*. Clip members 172 may in turn be releasably fixed to carrier member 112 by threaded bolt devices 174.

Stiffener-wear plate assemblies 88 are best shown in FIG. 3 as including a stiffener member 176, which has its opposite ends suitably affixed, as by welding, to facing surfaces of end plates 82, and a wear plate 178, which is removably fixed to the stiffener member, as by bolt devices 180, and serves to at least partially bound the inner surface of passageway 90.

A preferred form of stop device 24 is best shown in FIGS. 3, 4 and 12 as including a trough shaped support member 184, which has opposite end, opposite side and bottom walls 184*a*, 184*b* and 184*c*, respectively; and an L-shaped wear plate 186, which serves to define a convex stop surface 188 and is adapted to be removably fixed to bottom wall 184*c* by recessed screw devices 190. As will be apparent, the provision of abovementioned removable wear plates 136, 178 and 186, which serve to protect the fixed structural parts of rotor assembly 18 otherwise susceptable to wear, greatly increase the overall life of machine 10.

By referring particularly to FIGS. 4 and 12, it will be noted that end walls 184*a* are provided with aligned slots 192, which are arranged equidistant from side walls 184*b* to extend towards bottom wall 184*c*; and that bottom wall 184*c* and wear plate 186 are formed with aligned openings 194 dimensioned to loosely receive adjustment bolts 196 and aligned openings 198 dimensioned to afford access to adjustment bolts 200.

Stop device support assemblies 92 are best shown in FIGS. 3, 4 and 12 as including clamping devices 202 and adjustment devices 204, respectively. Clamping devices 202 each include a clamping plate 206 and a pair of bolt devices 208, which freely extend through end plate apertures 210 and slots 192 for threaded engagement with clamping plates 206, whereby to releasably clamp such plate against the inner surface of an adjacent end wall 184*a* and the outer surface of such end wall against an inner surface of an adjacent end plate 82. When bolts 208 are loosened to permit adjustment of stop 24 under the control of bolts 196 and 200 in the manner to be described, bolts 208 cooperate with slots 192 to constrain the stop device for movements essentially radially of the axis of drive shaft 20.

Adjustment devices 204 are best shown in FIGS. 4 and 12 as including multi-part brackets 212, which are adapted to be suitably affixed, as by welding, to the facing surfaces of end plates 82 and formed with pairs of threaded openings 214 and 216 adapted to receive bolts 196 and 200, respectively.

As will be apparent from viewing FIG. 4, the threading of bolts 196 and 200 into and out of their respective openings 214 and 216 serves to move stop device 24 radially of shaft 20, whereas simultaneous engagement of the heads of such bolts with the outer surface of wear plate 186 and the inner surface of bottom wall 184c, respectively, serves to position the stop device in a desired adjusted position in which it is releasably clamped by operation of clamping devices 202. Further, it will be understood that bolts 196 are spaced apart through a distance sufficient to avoid contact thereof with anvil bar 48 during rotations of rotor assembly 18.

By again referring to FIG. 2, it will be understood that during operation of machine 10, material 12 is fed through anvil assembly 16 and across anvil bearing surface 68 for leading end abutting engagement with one of stop surfaces 188 after a severing operation has been performed during passage of a preceding or relatively leading one of knife blades 22 in bearing engagement with such anvil bearing surface. As indicated above, the feeding of material 12 may be variously effected as by mechanical means and/or the force of gravity. Thereafter, an adjacent trailing or the next succeeding one of knife blades 22 is caused to pass through the previously positioned material 12, such that its leading end is cut off to form a chip, which passes through passageway 90 for subsequent discharge from machine 10. The radial spacing between the several stop surfaces 188 and anvil bearing surface 68, which serves to determine the length of chips severed from the leading end of material 12, may be varied by adjustments of bolts 196 and 200. Alternatively, stop devices 24 may be non-adjustably fixed to end plates 82 in those cases in which machine 10 is intended to produce chips of only one given length.

It will be understood that prior to the initiation of a chip severing operation, rotor assemby 18 is driven and anvil bar 48 is adjusted such that anvil bearing surface 68 is positioned for bearing engagement with knife blade bearing surfaces 104; this serving to form and/or smooth these bearing surfaces such that as to provide for uniform sliding engagement or minimum clearance surface contact therebetween and to work harden and thus increase the wear resistance of the tool steel from which the knife blades and anvil bar are formed. During this operation, it would be preferable to apply a smoothing agent to the bearing surfaces in order to reduce friction and dissipate heat, such agent including for instance a carrier liquid having lubricating properties and a fine grain, abrasive solid suspended within the liquid.

The chip severing operation can proceed after this initial bearing surface forming-smoothing operation. Thereafter, as the bearing surfaces become worn, such as to create excessive clearance or spacing therebetween, it will be necessary to effect adjustments of knife blades 22 and/or anvil bar 48. Periodic resharpending of knife blades 22 when required by deformation and/or dulling of knife edges 106, may be accomplished by reversing the bearing surfaces of the knife blades and performing the above described forming-smoothing operation.

Reference is now made particularly to FIGS. 15–19, which illustrate an alternative form of the machine of the present invention, wherein such machine is generally designated as 10' and components corresponding to those discussed with reference to machine 10 are designated by like prime numbers.

More specifically, machine 10' includes a framework 14'; an anvil assembly 16'; a carrier 18', which is supported on framework 14' and in turn serves to support a single knife blade 22' for movement relative to anvil assembly 16', as indicated by arrow "A'" and a single stop device 24'; a suitable drive arrangement 28'; and a guide trough assembly 230, which cooperates with guide chute 46' of anvil assembly 16' to feed material 12' to be severed. The included angle defined by knife blade bearing surfaces 104', which are preferably planar, may vary between about 20 degrees and 30 degrees, but it is preferable to provide a minimum blade angle consistent with blade strength requirements.

Figure 17:
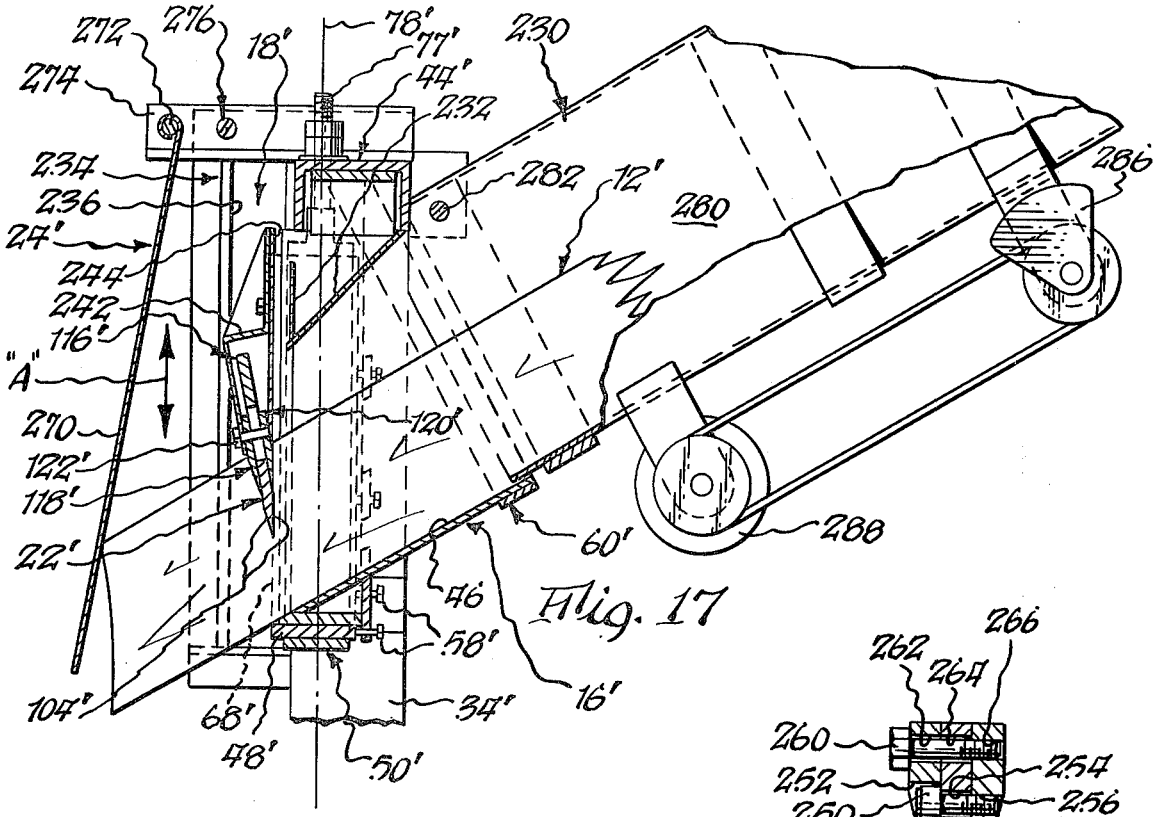
FIG. 17 is a sectional view taken generally along the line 17—17 in FIG. 15.

Anvil assembly 16' departs from assembly 16 primarily in that anvil bar 48' is formed with a planar anvil bearing surface 68'; and in that the anvil assembly is normally fixed to standards 34', such that the bottom of guide chute 46' forms an angle of approximately 30° relative to the horizontal, as best shown in FIG. 17. Also, in FIG. 17 there is shown an alternative construction of upper mounting portion 44', which necessitates the provision of a depending guide 232 arranged to cooperate with guide chute 46' in defining the opening through which material 12' may be passed.

Now referring to FIGS. 15, 17 and 18, it will be seen that carrier 18' differs from that previously described with reference to FIG. 10 in that it includes a pair of vertically extending guide devices 234, which serve to define aligned guide slots 236 arranged essentially parallel to plane 78'; and a pair of follower devices 238, which are loosely supported within guide slots 236 for vertically directed reciprocating movements under the control of drive arrangement 28'. Follower devices 238 are formed with mounting plates 240, which when connected to knife blade supporting assembly in the manner to be described are disposed in a parallel relationship and inclined relative to plane 78' through an angle essentially corresponding to one-half of the included angle defined by knife blade bearing surfaces 104'.

Figure 18:
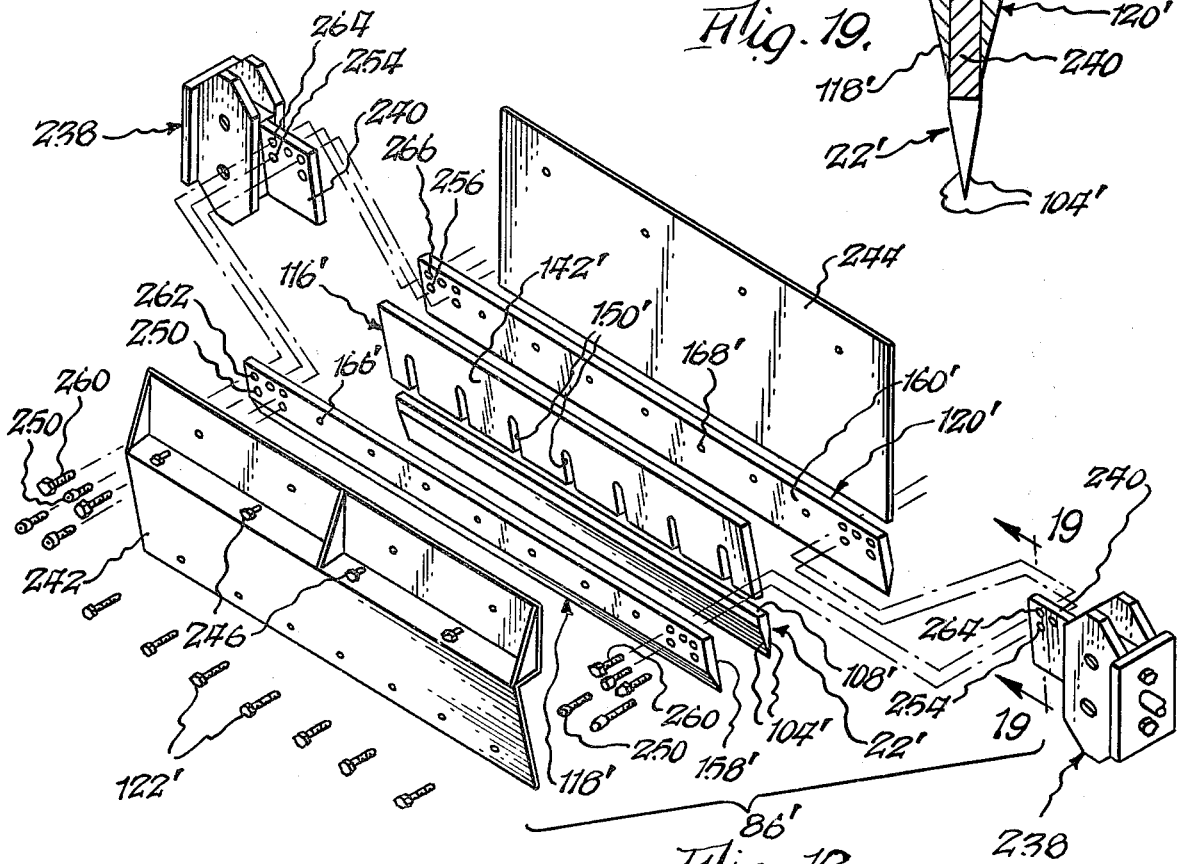
FIG. 18 is an exploded perspective view showing the knife blade and its associated supporting assembly for use in the alternative form of the apparatus shown in FIG. 15.

Knife blade supporting assembly 86' is best shown in FIGS. 17 and 18 as including an adjustment plate 116'; a pair of clamping plates 118' and 120'; and a plurality of bolts 122', which are sized to freely pass through openings 166' and slots 150' and be threadably received within openings 168' for the purpose of releasably clamping surfaces 158' and 160' of clamping plates 118' and 120', respectively, in lapping engagement with the clamping surfaces of knife blade 22' and adjustment plate 116'. If desired, knife blade 22' and adjustment plate 116' may be releasably bolt connected in the manner previously discussed with reference to FIG. 5. Preferably, supporting assembly 86' would additionally include a rigidifying bracket 242, which would be removably affixed to clamping plate 118' by bolts 122', and a blocking plate 244 suitably fixed to bracket 242 as by bolts 246. As will be apparent from viewing FIG. 17, blocking plate 244 has its lower edge arranged to lie immediately adjacent clamping plate 120' and is vertically dimensioned such that the material feed opening defined by guide chute 46' and guide 232 is completely closed or covered when knife blade 22' is in its lowermost or material severed position shown in phantom line in FIG. 15. In this manner, the jamming of material 12' between assembly 86' and guide 232, during upwardly directed movements of knife blade 22' into its uppermost or initial position shown in solid line in FIG. 15, is prevented.

Figure 19:
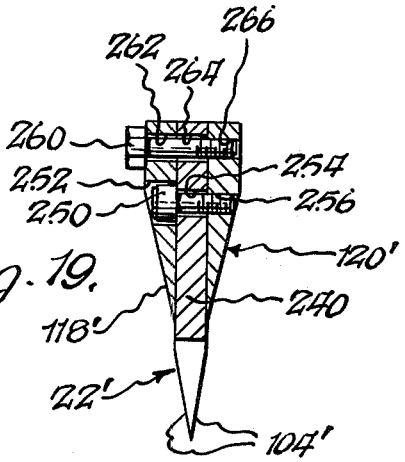
FIG. 19 is a sectional view taken generally along the line 19—19 in FIG. 18.

Now making reference to FIGS. 18 and 19, it will be understood that assembly 86' is fixed to follower devices 238 by the expedient of having the opposite ends of clamping plates 118' and 120' arranged to extend beyond opposite ends of knife blade 22' and adjustment plate 116' for receipt of mounting plates 240 in a sandwiched relationship therebetween. More specifically, the projecting ends of clamping plates 118' and 120' are releasably clamped to opposite side surfaces of mounting plates 240 by means of bolt devices 250, each of which has its enlarged head freely received within an access bore opening 252 formed in clamping plte 118' and its shank end freely received within a bore opening 154 formed in mounting plate 240 and threadably received within threaded opening 256 formed in clamping plate 120'; and by bolt devices 260, each of which has its enlarged head arranged to bear against clamping plate 118' and its shank end freely received within bore openings 262 and 264 formed in clamping plate 118' and mounting plate 240, respectively, and threadably received within threaded opening 266 formed in clamping plate 120'. As will be apparent, with this arrangement, bolts 250 serve to normally clamp assembly 86' relative to plates 240, while permitting bolts 260 to be loosened when required to effect adjustments and/or removal of knife blade 22'.

Stop device 24' is best shown in FIGS. 15 and 17 as including a stop plate 270, which is suspended via a horizontally disposed pivot pin or shaft 272 from a pair of brackets 274, which are in turn fixed to the upper ends of either guide devices 234 or standards 34'. In either event, brackets 274 would preferably be adjustably mounted, as by a screw slot arrangement 276, in order to permit adjustments in the position of stop plate 270 relative to anvil bearing surface 68' for the purpose of adjustably controlling the length of chips to be formed. It will be apparent from viewing FIG. 15 that the weight of stop plate 270 normally tends to bias same to assume a reference position in which it is vertically disposed and arranged essentially parallel to plane 78'. Alternatively, a suitable spring device 278 may be employed to assist the force of gravity in tending to maintain stop plate 270 in its reference position.

It will be understood that when knife blade 22' is disposed in its upper position, material fed to anvil assembly 16' is free to pass downwardly across anvil bearing surface 68' for leading and abutting engagement with stop plate 270; the bias acting on stop plate 270 normally being sufficient to prevent swinging movements thereof away from its reference position in response to such engagement. During subsequent downward movement of knife blade 22', a chip having a thickness corresponding essentially to the distance between stop plate 270, when in its reference position, and anvil bearing surface 68' is severed or sliced from the leading end of material 12'. As knife blade 22' penetrates material 12', the latter tends to be deformed with the result that forces are created, which in turn tend to force stop plate 270 to swing upwardly from its reference position, as indicated in an exaggerated manner in FIG. 17. However, the bias acting on stop plate 270 is sufficiently great, so as to minimize deflection of the stop plate from its reference position with the result that the above mentioned forces serve to press or move knife blade bearing surface 104' into surface to surface bearing engagement with anvil bearing surface 68'. After the severing operating has been completed, the pressure acting on knife blade 22' is relieved with the result that bearing surface 104' is freed from bearing engagement with anvil bearing surface 68, during upward or retracting movement of the knife blade. As in the manner previously described with reference to machine 10, sliding surface engagement of knife blade bearing surface 104' with anvil bearing surface 68' serves to continuously smooth and harden these surfaces, whereas reversal of surfaces 104' serves to effect resharpening of the knife blade. Also, the wearing away of anvil bearing surface 68' may be compensated for by adjustments of screw devices 58'.

Again referring to FIGS. 15 and 17, it will be seen that trough assembly 230 includes an upwardly opening generally U-shaped guide trough 280, which has its lower end arranged to overlie an upper end of guide chute 46'. Guide trough 280 is supported adjacent its lower end by framework mounted bearing pins 282 for movements about horizontally disposed pivot axis, which is arranged essentially parallel to plane 78', and is supported adjacent its upper end by framework mounted spring assemblies 284. Spring assemblies tend to resiliently oppose or cushion swinging movements of guide trough 280 about its pivot axis from a reference position in which it is disposed in essential alignment with guide chute 46', as best shown in FIG. 17. Guide trough 280 additionally serves to support a pair of eccentric weights 286, which are driven by an electric motor 288 for rotation about an axis disposed essentially parallel to the pivot axis of the guide trough. By this arrangement, guide trough 280 is forced to undergo limited, oscillatory pivotal movements about its pivot axis, which movements cooperate with the force of gravity in feeding material 12' to anvil assembly 16'.

I claim:

1. In an apparatus for reducing fiber material to chip form, including anvil means across which said material is to be fed, at least one knife means, and carrier means for moving said knife means along a path of travel past said anvil means for cooperation therewith to effect severing of said material into chip form, the improvement wherein said carrier means includes a rotor driven for rotation about an axis, said blade means including an elongated knife blade supported adjacent the periphery of said rotor with a knife edge thereof arranged essentially parallel to said axis and facing in the direction of rotation of said rotor for movement along a circular path of travel, said anvil means defining an arcuately concave anvil bearing surface arranged to face towards and conform to the contour of said path of travel, said anvil bearing surface including leg portions joined by a connecting portion, said leg portions being spaced apart to accommodate feeding of said material therebetween and across said anvil bearing surface, said knife blade having a lengthwise dimension sufficient to bridge between said leg portions, said knife blade including a pair of surfaces converging to define said knife edge, said carrier means positioning at least one of the converging surfaces of said knife blade for surface-to-surface bearing engagement with said anvil bearing surface in a direction extending from adjacent free ends of said leg portions towards said connecting portion, whereby to reduce to chip form said material fed across said anvil bearing surface, and means are provided for controlling the length of the chips being formed.

2. An apparatus for reducing fiber material to chip form, including anvil means across which said material is to be fed, at least one knife means, and carrier means for moving said knife means along a path of travel past said anvil means for cooperation therewith to effect severing of said material into chip form and means for controlling the length of chips being formed, the improvement wherein said anvil means defines an anvil bearing surface arranged to face towards and conform to the contour of said path of travel, said anvil bearing surface including leg portions joined by a connecting portion, said leg portions being spaced apart to accommodate feeding of said material therebetween and across said anvil bearing surface, said knife means including an elongated knife blade having a lengthwise dimension sufficient to bridge between said leg portions, said knife blade including a pair of surfaces converging to define a knife edge extending lengthwise of said knife blade, said carrier means supporting said knife blade for movement along said path of travel and to position at least one of the converging surfaces of the knife blade for surface-to-surface bearing engagement with said anvil bearing surface in a direction extending from adjacent free ends of said leg portions towards said connecting portion, whereby to reduce to chip form said material fed across said anvil bearing surface, said knife blade additionally including a pair of essentially parallel and oppositely facing clamping surfaces, said converging surfaces extending one from each of first marginal edges of said clamping surfaces and forming essentially equal angles relative thereto, and a rear surface joining second marginal edges of said clamping surfaces arranged essentially parallel to said first marginal edges; and said carrier means including an elongated adjustment plate having a pair of essentially parallel and oppositely facing clamping surfaces joined by a plate bearing surface having a transverse width corresponding to that of said rear surface and a plurality of essentially parallel slots opening through said clamping surfaces thereof and plate bearing surface, a pair of elongated clamping means having facing clamping surfaces and oppositely facing clearance surfaces forming essentially equal angles relative to their associated clamping surfaces and diverging from adjacent first marginal edges thereof, one of said clamping means having a plurality of bore openings extending through said clamping surface thereof and spaced apart one for alignment with each of said slots, another of said clamping means having a plurality of threaded openings extending through said clamping surface thereof and spaced apart one for alignment with each of said bore openings and slots, and means including a plurality of bolts adapted to be freely inserted one through each of said bore openings and said slots and threaded into said threaded openings for releasably retaining said clamping surfaces of said clamping means in overlapping clamping engagement with said clamping surfaces of said knife blade and adjustment plate and for retaining said plate bearing surface in surface-to-surface abutting engagement with said rear surface and for retaining said clearance surfaces in essential alignment one with each of said converging surfaces.

3. An apparatus according to claim 2, wherein said carrier means additionally includes a rotor disposed for rotation about an essentially horizontally disposed axis and a carrier member fixed to said rotor to extend parallel to said axis, said carrier member having a plurality of bore openings arranged for alignment with the first said bore openings and said slots and said threaded openings, said bolts having head portions arranged to thrust against said carrier member and having threaded shank portions arranged to extend essentially radially of said axis outwardly through said bore openings of said carrier member and the first said bore openings and said slots and said threaded openings whereby to releasably and clampingly support said knife blade to extend essentially parallel to said axis and for movement along a circular path of travel, and said anvil bearing surface is arcuate.

4. An apparatus according to claim 3, wherein said anvil means includes generally U-shaped guide means for supporting said material to be severed, a generally U-shaped anvil bar defining said anvil bearing surface, means for releasably clamping said anvil bar to said guide means, and means carried on said guide means for adjustably moving said anvil bearing surface towards said path of travel.

5. An apparatus according to claim 2, wherein said clamping means have opposite ends thereof arranged to extend beyond opposite ends of said knife blade and said adjustment plate, and said carrier means additionally includes a pair of vertically extending guide devices, a pair of follower devices constrained for vertically directed reciprocating movement one in association with each of said guide devices, said follower devices having mounting plates dimensioned to be sandwiched between said opposite ends of said clamping means, means for driving at least one of said follower devices for vertically directed reciprocating movements, and means for releasably attaching said mounting plates to said opposite ends of said clamping means whereby to constrain said knife blade to extend horizontally intermediate said guide devices for movement along a vertically directed path of travel, and said mounting plates being parallel and inclined relative to said path of travel through an angle essentially corresponding to one half of an included angle defined by said converging surfaces.

6. An apparatus according to claim 5, wherein said included angle is approximtely 20°.

7. An apparatus according to claim 5, wherein said anvil means includes a generally U-shaped guide means for supporting said material to be severed, a generally U-shaped anvil bar defining said anvil bearing surface, means for releasably clamping said anvil bar to said guide means, and means carried on said guide means for adjustably moving said anvil bearing surface towards said path of travel, and said guide means is inclined in a direction downwardly towards said path of travel.

8. An apparatus according to claim 5, wherein said guide means is disposed at an angle relative to horizontal of approximately 30°, and said included angle is approximately 20°.

9. An apparatus for reducing fibre material to chip form, which comprises in combination:

a framework;

a rotor supported on said framework for driven rotation about an axis;

a plurality of elongated knife blades, each of said knife blades having a pair of surfaces converging to define a knife edge extending lengthwise of its associated knife blade;

means for supporting said knife blades in spaced relationship about the periphery of said rotor with said knife blades having their knife edges arranged essentially parallel to and equidistant from said axis, and facing in the direction of rotation of said rotor, whereby said knife edges are caused to move along a circular path of travel upon rotation of said rotor, and said knife blades each having one of the converging surfaces thereof disposed essentially tangent to said path of travel;

a plurality of stop means defining stop surfaces;

means for supporting said stop means peripherally of said rotor and intermediate said knife blades with said stop surfaces arranged to face radially outwardly of said axis, said stop surfaces being disposed radially inwardly of said path of travel; and an anvil assembly fixed to said framework and defining an anvil bearing surface, said anvil bearing surface including a pair of leg portions extending generally transversely of said axis and a connecting portion joining said leg portions, said leg portions being spaced apart to accommodate for passage of said material therebetween and across said anvil bearing surface in a direction towards said rotor, each of said knife edges having a lengthwise dimension sufficient to bridge across said leg portions, said anvil bearing surface conforming to the contour of said path of travel, said anvil bearing surface being radially spaced from said axis and arranged relative to said direction of rotation of said rotor for permitting surface-to-surface engagement of said one of said converging surfaces of said knife blades with said anvil bearing surface in a direction extending from adjacent free ends of said leg portions towards said connecting portion, whereby to reduce to chip form said material passing across said anvil bearing surface towards said rotor, and said stop surfaces serving to limit the length of said material passing across said anvil bearing surface.

10. An apparatus according to claim 9, wherein said anvil assembly includes guide means for supporting said material for passage between said leg portions, an anvil bar defining said anvil bearing surface, means for releasably clamping said anvil bar to said guide means and means for adjustably moving said anvil bearing surface towards said path of travel to accommodate for wearing away of said anvil bearing surface.

11. An apparatus according to claim 9, wherein said anvil assembly comprises a frame having a generally U-shaped lower portion including means for guiding said material towards said rotor and an upper mounting portion bridging between upper end portions of said lower portion, a generally U-shaped anvil bar defining said anvil bearing surface, a generally U-shaped strap member, means for releasably connecting upper end portions of said strap member to said upper mounting portion whereby to releasably clamp said anvil bar against a lower surface of said lower portion, and means carried by said lower portion for engagement with said anvil bar and operable to effect movement of said anvil bearing surface towards said path of travel.

12. An apparatus according to claim 11, wherein said framework includes a pair of essentially parallel and vertically extending standards defining mounting surfaces arranged essentially parallel to said axis and facing guide surfaces, said standards being disposed adjacent axially opposite ends of said rotor and spaced one from another to permit said facing guide surfaces to loosely slide fit accommodate said frame of said anvil assembly therebetween, said frame being fixed to said standards by means of a pair of parallel flanges having facing surfaces thereof fixed to said upper portion of said frame, and said flanges having marginal edges thereof arranged to lap said standards and be weld fixed to said mounting surfaces of said standards.

13. An apparatus according to claim 9, wherein each of said stop means includes a support member fixed to said rotor and a wear plate removably fixed to said support member and said wear plate defines said stop surface.

14. An apparatus according to claim 9, wherein said means for mounting said stop means includes means for adjustably positioning said stop surfaces radially of said axis whereby to adjustably vary the lengths of chips severed from said material.

15. An apparatus according to claim 9, wherein said rotor includes a pair of essentially parallel end plates disposed normal to said axis, each of said stop means including a trough shaped support member having opposite ends, opposite side and bottom walls and a wear plate defining the stop surface thereof and removably fixed to said bottom wall, said end walls having slot openings therethrough and arranged to extend intermediate said side walls towards said bottom wall, and said means for mounting said stop means includes a pair of clamping plates arranged within said support member adjacent said end walls, bolt means extending through said end plates of said rotor and through said slots for threaded engagement with said clamping plates whereby to releasably clamp said clamping plates against inner surfaces of said end walls and outer surfaces of said end walls against facing surfaces of said end plates and to guide said support member for movements essentially radially of said axis, a pair of adjustment bracket members fixed to said facing surfaces of said end plates of said rotor and having threaded opening defining portions projecting inwardly of said support member adjacent said end walls thereof, and pairs of bolt members threadably received within said threaded portions of each of said bracket members for adjustably moving said support member radially of said axis, a first bolt of each of said pairs of bolts freely extending through an opening in said bottom wall of said support member and an opening in said wear plate and having an enlarged head portion thereof arranged to bear against said wear plate, and a second bolt of each of said pairs of bolts having an enlarged head portion thereof arranged to bear against an inner surface of said bottom wall of said support member peripherally of an access-adjustment opening formed in said bottom wall in alignment with an access-adjustment opening formed in said wear plate.

16. An apparatus according to claim 9, wherein said rotor includes a pair of parallel end plates arranged to extend radially of said axis, at least one of said end plates having air inlet means arranged adjacent said axis, a plurality of stiffener-fan blade elements having opposite end marginal edges thereof fixed to facing surfaces of said end plates, said blade elements extending generally radially of said axis, a plurality of stiffener-wear plate assemblies associated one with each of said knife blades and cooperating with an associated one of said means for supporting said knife blades to define a chip flow passageway, said passageway having an inlet and an outlet opening radially outwardly of said axis and arranged respectively in a leading and trailing relationship relative to its associated knife blade in the direction of rotation of said rotor, each of said blade elements having a radially outer marginal edge portion terminating intermediate one of said stiffener-wear plate assemblies and a trailing one of said stop means in the direction of rotation of said rotor and cooperating with said one of said stiffener-wear plate assemblies to define an air jet nozzle extending essentially between said end plates of said rotor and supplied with air passing inwardly of said rotor through said air inlet means to provide upon rotation of said rotor an air jet directed generally radially outwardly of said axis adjacent said outlet of said chip flow passageway.

17. An apparatus according to claim 16, wherein means are provided for controlling the flow of air into said rotor through said air inlet means.

18. An apparatus according to claim 16, wherein each of said stiffener-wear plate assemblies includes a stiffener member having opposite ends thereof fixed to said end plates and a wear plate removably fixed to said stiffener member and arranged to partially bound an inner surface of said passageway, and said associated one of said means for supporting said knife blades includes a carrier member having opposite ends fixed to said end plates and a wear plate removably fixed to said carrier member and arranged to partially bound an outer surface of said passageway, said knife blades being fixed to their associated carrier members.

19. An apparatus according to claim 9, wherein means are fixed to said rotor radially inwardly of said path of travel one in association with each of said means for supporting said knife blades and cooperates therewith to define a chip flow passageway, said passageway having an inlet and an outlet opening radially outwardly of said axis and arranged respectively in a leading and trailing relationship relative to its associated knife blade in the direction of rotation of said rotor.

20. An apparatus according to claim 19, wherein a plurality of cutting elements are supported by one of said means cooperating to define said passageway to project transversely within said passage in a direction radially of said axis.

21. An apparatus according to claim 20, wherein each of said cutting elements is a flat plate shaped to define a cutting edge extending along one marginal edge thereof and a mounting enlargement arranged remotely of said cutting edge and projecting from oppositely facing flat surfaces thereof, said cutting elements being maintained in a parallel spaced relationship and removably fixed to said means for supporting said knife blades by a plurality of clip members, and a pair of said clip members being arranged to positionally engage said oppositely facing flat surfaces of each said flat plate and to clampingly engage its associated mounting enlargement.

22. An apparatus according to claim 9, wherein each of said knife blades includes a pair of essentially parallel and oppositely facing clamping surfaces, said converging surfaces converged in an essentially uniform manner one from adjacent each of said clamping surfaces, and each of said means for supporting said knife blades includes means for releasably and clampingly engaging said clamping surfaces for alternately positioning each of said converging surfaces for surface-to-surface engagement with said anvil bearing surface.

23. An apparatus according to claim 22, wherein said converging surfaces are convex and essentially conform to said contour of said path of travel.

24. An apparatus according to claim 9, wherein each of said knife blades includes a pair of essentially parallel and oppositely facing clamping surfaces, said converging surfaces converge in an essentially uniform manner one from adjacent first marginal edges of each of said clamping surfaces, and a rear bearing surface joining second marginal edges of said clamping surfaces arranged essentially parallel to said first marginal edges thereof; and each of said means for supporting said knife blades includes an elongated adjustment plate having a pair of essentially parallel and oppositely facing clamping surfaces joined by a front bearing surface having a transverse dimension corresponding to that of said rear bearing surface and a plurality of essentially parallel slots opening through said clamping surfaces and front bearing surface thereof, radially inner clamping means including a carrier member arranged parallel to said axis and having opposite ends thereof fixedly supported by said rotor, radially outer clamping means and a plurality of bolts passing radially through said radially inner clamping means and said slots and said radially outer clamping means for releasably retaining said radially outer and radially inner clamping means in lapping engagement with said clamping surfaces of said knife blade and said adjustment plate, one of said radially inner and radially outer clamping means includes means for adjustably reciprocating said adjustment plate in a direction lined with said slots, and means are provided to releasably couple said rear bearing surface to said front bearing surface, whereby said knife blade is caused to undergo conjunctive reciprocating movements with said adjustment plate.

25. An apparatus according to claim 24, wherein said radially outer clamping means is a wear plate having a radially outer surface essentially conforming to the contour of said path of travel.

26. An apparatus according to claim 24, wherein said radially inner clamping means supports said means for adjustably reciprocating said adjustment plate.

27. An apparatus according to claim 26, wherein said adjustment plate has a rear adjustment surface arranged parallel to said front bearing surface, and said means for adjustably reciprocating said adjustment plate includes a plurality of set screw devices threadably supported by said carrier member for end bearing engagement with said rear adjustment surface and a plurality of bolt devices having head end portions arranged for bearing engagement with said carrier member and threaded shank portions freely extending through said carrier member and through said rear adjustment surface for receipt within threaded openings defined by said adjustment plate, said set screw and bolt devices having their axis aligned with the direction of reciprocating movements of said adjustment plate.

28. An apparatus according to claim 24, wherein a plurality of stiffener-wear plate assemblies are fixed to said rotor in association one with each of said radially inner clamping means and cooperate therewith to define a chip flow passageway, said passageway having an inlet and an outlet opening radially outwardly of said axis and arranged respectively in a leading and trailing relationship relative to its associated knife blade in the direction of rotation of said rotor, each of said stiffener-wear plate assemblies including a stiffener member having opposite ends thereof fixed to said rotor to extend parallel to said axis and a wear plate removably fixed to said stiffener member and arranged to radially inwardly bound said passageway, and said radially outer clamping means includes a wear plate removably fixed to said carrier member and arranged to radially outwardly bound said passageway.

29. An apparatus according to claim 24, wherein means are fixed to said rotor radially inwardly of said path of travel one in association with each of said radially inner clamping means and cooperates therewith to radially bound a chip flow passageway, said passageway having an inlet and an outlet opening radially outwardly of said axis and arranged respectively in a leading and trailing relationship relative to its associated knife blade in the direction of rotation of said rotor, and said anvil assembly comprises a frame having a generally U-shaped lower portion including means for guiding said material towards said rotor and an upper mounting portion bridging between upper end portions of said lower portion, a generally U-shaped anvil bar defining said anvil bearing surface, a generally U-shaped strap member, means for releasably connecting upper end portions of said strap member to said upper mounting portion whereby to releasably clamp said anvil bar against a lower surface of said lower portion, and means carried by said lower portion for engagement with said anvil bar and operable to effect movement of said anvil bearing surface towards said path of travel.

30. An apparatus according to claim 29, wherein said rotor includes a pair of essentially parallel end plates disposed normal to said axis, said stop means includes a trough shaped support member having opposite end, opposite side and bottom walls and a wear plate defining said stop surface and removably fixed to said bottom wall, said end walls having slot openings therethrough and arranged to extend intermediate said side walls towards said bottom wall, and said means for mounting said stop means includes a pair of clamping plates arranged within said support member adjacent said end walls, bolt means extending through said end plates of said rotor and through said slots for threaded engagement with said clamping plates whereby to releasably clamp said clamping plates against inner surfaces of said end walls and outer surfaces of said end walls against facing surfaces of said end plates and to guide said support member for movements essentially radially of said axis, a pair of adjustment bracket members fixed to said facing surfaces of said end plates of said rotor and having threaded opening defining portions projecting inwardly of said support member adjacent said end walls thereof, and pairs of bolt members threadably received within said threaded portions of each of said bracket members for adjustably moving said support member radially of said axis, a first bolt of each of said pairs of bolts freely extending through an opening in said bottom wall of said support member and an opening in said wear plate and having an enlarged head portion thereof arranged to bear against said wear plate, and a second bolt of each of said pairs of bolts having an enlarged head portion thereof arranged to bear against an inner surface of said bottom wall of said support member peripherally of an access-adjustment opening formed in said bottom wall in alignment with an access-adjustment opening formed in said wear plate.

31. An apparatus for reducing fibrous material to chip form, which comprises in combination:

an elongated knife blade, including a pair of surfaces converging to define a knife edge extending lengthwise of said knife blade;

means for supporting said knife blade to extend essentially horizontally and for vertical reciprocating movements between an upper inoperative position and a lower material severing position, said knife edge being arranged to face downwardly with one of the converging surfaces thereof being arranged to lie within an essentially vertically disposed plane;

an anvil assembly disposed adjacent one side of said plane and including an anvil bearing surface having generally vertically extending leg portions and a lower leg connecting portion, said anvil bearing surface being arranged essentially coincident with said plane;

means for guiding said material downwardly across said plane intermediate said leg portions and said connecting portion; and stop means disposed adjacent an opposite side of said plane and biased to assume a reference position wherein said stop means is to be engaged by said material passing downwardly across said plane, the spacing between said stop means when in said reference position and said anvil bearing surface serving to determine the length of chips to be severed by said knife blade during movement thereof between said upper and lower positions, said stop means being supported for movement from said reference position against said bias in a direction away from said plane incident to passage of said knife blade through said material, and said bias operating via said material during passage of said knife blade therethrough intending to maintain said one of said converging surfaces in surface-to-surface engagement with said anvil bearing surface.

32. An apparatus according to claim 31, wherein said means for guiding said material includes an upwardly opening guide chute rigidly fixed to said anvil assembly and having a lower end terminating adjacent said plane, said guide chute conforming to the contour of said leg portions and said connecting portion and being disposed inwardly thereof; an upwardly opening guide trough; and means to support said guide trough in essential alignment with said guide chute, the last said means including means to support a lower end of said guide trough to closely overlie an upper end of said guide chute and for movement about a horizontally disposed pivot axis arranged parallel to said plane and means to vibrate said trough for vertically directed oscillatory movements above said pivot axis.

33. An apparatus according to claim 31, wherein said means for supporting said knife blade includes means to releasably clamp said knife blade to alternately position said converging surfaces to lie within said plane.

34. An apparatus according to claim 33, wherein said converging surfaces cooperate to define a knife edge angle of approximately 20°, and said means for guiding said material downwardly across said plane includes an upwardly opening guide chute conforming to the contour of said leg portions and said connecting portions and disposed inwardly thereof, said guide chute having a lower end terminating adjacent said plane and being inclined relative to the horizontal through an angle of approximately 30°.

35. An apparatus for reducing fibrous material to chip form, which comprises in combination:

a framework;

an elongated knife blade, said knife blade defining a pair of surfaces converging to define a knife edge extending lengthwise of said knife blade;

means for supporting said knife blade to extend horizontally of said framework to position said knife edge to face downwardly with one of the converging surfaces thereof arranged to lie essentially within a vertically disposed plane and for effecting vertically directed reciprocating movements of said knife blade between an upper inoperative position and a lower material severing position;

an anvil assembly fixed to said framework and arranged adjacent one side of said plane, said anvil assembly including a generally U-shaped guide chute for guiding said material for movement in a direction downwardly towards said plane and anvil means outwardly bounding a lower end of said guide chute and serving to define a generally U-shaped anvil bearing surface arranged essentially coincident with said plane; and a stop plate disposed adjacent an opposite side of said plane and biased to assume a reference position wherein said stop plate is positioned for engagement by said material passing through said guide chute and downwardly across said plane, the horizontal spacing between said stop plate when in said reference position and said anvil bearing surface determining the length of chips to be severed by said knife edge during movement thereof between said upper and lower positions, said stop plate being supported for movement from said reference position against said bias in a direction away from said plane incident to passage of said knife edge through said material, and said bias operating via said material during passage of said knife blade therethrough in tending to maintain said one of said converging surfaces in surface-to-surface engagement with said anvil bearing surface.

36. An apparatus according to claim 35, wherein said anvil means includes a generally U-shaped anvil bar conforming essentially to the external configuration of said guide chute, and said anvil assembly includes means for releasably clamping said anvil bar to said guide chute and means for adjustably moving said anvil bearing surface normal to said plane.

37. An apparatus according to claim 35, wherein said anvil assembly additionally includes a frame having a generally U-shaped lower portion and an upper mounting portion bridging between upper end portions of said lower portion, said lower end of said guide chute lies within and is rigidly fixed to said U-shaped lower portion, said anvil bearing surface is defined by a generally U-shaped anvil bar, and said anvil bar is clampingly and removably fixed to an outer surface of said U-shaped lower portion by a generally U-shaped strap member having upper ends thereof removably fixed to said upper mounting portion, and said anvil assembly additionally includes means carried by said U-shaped lower portion for engagement with said anvil bar and operative to effect movement of said anvil bearing surface normal to said plane.

38. An apparatus according to claim 35, wherein said stop plate is suspended from said framework for vertical swinging movements above a horizontally disposed pivot axis arranged essentially parallel to said plane and the weight of said stop plate tends to bias said stop plate to assume said reference position wherein said stop plate is disposed essentially parallel to said plane.

39. An apparatus according to claim 38, wherein spring means are provided for cooperation with the weight of said stop plate to bias said stop plate to assume said reference position.

40. An apparatus according to claim 35, wherein said means for supporting said knife blade includes a pair of vertically extending guide devices arranged essentially parallel to said plane, a pair of follower devices driven for vertically directed reciprocating movements one in association with each of said guide devices and means to releasably connect opposite ends of said knife blade one to each of said follower devices.

41. An apparatus according to claim 35, wherein said means for supporting said knife edge includes clamping means adapted to releasably clamp said knife edge for alternatively positioning said converging surfaces to lie essentially within said plane; a pair of vertically extending guide devices arranged essentially parallel to said plane; a pair of follower devices driven for vertically directed reciprocating movements one in association with each of said guide devices, said follower devices having mounting plates disposed in a parallel relationship and inclined relative to said plane through an angle essentially corresponding to one-half of an included angle defined by said converging surfaces; and means for releasably attaching said clamping means to said mounting plates.

42. An apparatus according to claim 41, wherein said knife blade defines a pair of parallel clamping surfaces, said converging surfaces uniformly converging one from each of first marginal edges of said clamping surfaces, and a rear bearing surface extending between second marginal edges of said clamping surfaces spaced in a parallel relationship relative to said first marginal edges, said means for supporting said knife edge additionally includes an adjustment plate having parallel clamping surfaces, a bearing surface connecting said clamping surface thereof and arranged to bear on said rear surface of said knife blade and a plurality of slots opening through said clamping surfaces and said bearing surface thereof, said clamping means includes a pair of clamping plates and bolt means passing through said slots for releasably clamping said clamping plates in lapping engagement with said clamping surfaces of said knife blade and said adjustment plate, said clamping plates having opposite ends thereof arranged to extend beyond opposite ends of said knife blade and adjustment plate for receipt of said mounting plates in a sandwiched relationship therebetween, and said opposite ends of said clamping plates being releasably bolt connected to said mounting plates.

43. An apparatus according to claim 42, wherein said stop plate is suspended from said framework for vertical swinging movements about a horizontally disposed pivot axis arranged essentially parallel to said plane and the weight of said stop plate tends to bias said stop plate to assume said reference position wherein said stop plate is disposed essentially parallel to said plane, and said apparatus further includes an upwardly opening generally U-shaped guide trough having a lower end thereof arranged to overlie an upper end of said guide chute, said guide trough being supported adjacent said lower end thereof on said framework for movements about a horizontally disposed pivot axis arranged parallel to said plane, said guide trough mounting an eccentric weight for rotation about an axis disposed essentially parallel to said pivot axis thereof, and said trough having its upper end supported on said framework by spring assemblies tending to resiliently oppose swinging movements of said guide trough about said pivot axis thereof from a reference position in which it is essentially aligned with said guide chute.

44. An anvil assembly intended to be mounted in a machine in cooperation with at least one knife blade movable along an annular path of travel for reducing fiber material to chip form, said anvil assembly including in combination:

a guide chute for said material for fiber material to be reduced, said guide chute having an essentially U-shaped cross-sectional configuration and spaced inlet and outlet ends;

a generally U-shaped anvil bar including a pair of leg portions and a leg connecting portion cooperating to define an anvil bearing surface, said bearing surface being concave in a direction extending from adjacent free ends of said leg portions towards said connecting portion and conforming essentially to the contour of said path of travel; and support means to removably support said anvil bar outwardly of said guide chute and adjacent said outlet end with said bearing surface projecting beyond said outlet end in a direction away from said inlet end.

45. An anvil assembly intended to be mounted in a machine in cooperation with at least one knife blade movable along a path of travel for reducing fiber material to chip form, said anvil assembly comprising in combination:

a frame for mounting said anvil assembly on said machine, said frame having a generally U-shaped lower portion and an upper portion bridging between upper ends of said lower portion;

an upwardly open guide chute for feeding said material to said machine, said guide chute having an essentially U-shaped cross-sectional configuration and spaced inlet and outlet ends, said outlet end being rigidly fixed to an inner surface of said U-shaped lower portion;

a generally U-shaped anvil bar having a pair of leg portions and a leg connecting portion cooperating to define an anvil bearing surface conforming essentially to the contour of said path of travel;

a generally U-shaped strap member having a pair of leg portions and a connecting portion, said leg portions of said strap member having free ends thereof removably fixed to said upper mounting portion for removably clamping said leg portions and said connecting portion of said anvil bar against an outer surface of said U-shaped lower portion thereby to arrange said anvil bearing surface to project beyond said outlet end and said U-shaped lower portion in a direction away from said inlet end.

46. An anvil assembly according to claim 45, wherein a common plane passes through said leg portions and said connecting portion of said anvil bar and through said leg portions and said connecting portion of said strap member, said guide chute forms an actue angle with said plane, and adjustment means are fixed to said U-shaped lower portion for engagement with a surface of said anvil bar spaced from said anvil bearing surface and disposed essential parallel to said plane, said adjustment means being operative to move said anvil bearing surface in a direction essentially normal to said plane.

47. A method for reducing fiber material to chip form including the steps of:

providing a knife blade supported for movement along a path of travel, said knife blade being formed of tool steel and having an elongated knife edge defined by a pair of converging surfaces;

providing an anvil formed of tool steel and shaped to define an anvil bearing surface conforming essentially to the contour of said path of travel;

moving said knife blade along said path of travel;

positioning said anvil bearing surface to lie essentially coincident with said path of travel and for sliding surface engagement with one of said surfaces of said knife blade at least adjacent said knife edge, whereby to form the engaged surfaces of said knife blade and said anvil to closely conform to one another and permit uniform surface engagement therebetween and to produce surface hardening of said engaged surfaces;

passing said material across said anvil bearing surface for engagement by said knife edge as said knife blade moves along said path of travel whereby said knife edge cooperates with said anvil bearing surface to effect severing of a chip from said material; and periodically resharpening said knife blade by arranging another of said surfaces thereof for sliding surface engagement with said anvil bearing surface.

48. A method according to claim 47, wherein said knife blade is moved along an annular path of travel about an axis with said knife edge disposed parallel to said axis, and said anvil bearing surface is concave and defined by a pair of leg portions extending transversely of said axis and spaced apart to receive said material for passage therebetween and a leg connecting portion leading said leg portions in the direction of movement of said knife blade along said path of travel.

49. In an apparatus for reducing fiber material to chip form, including anvil means across which said material is to be fed, a knife blade and carrier means for moving said knife blade along a path of travel past said anvil means for cooperation therewith to effect severing of said material into chip form, the improvement wherein said anvil means defines an essentially planar anvil bearing surface facing towards said path of travel, said anvil bearing surface including leg portions joined by a connecting portion, said leg portions being spaced apart to accommodate feeding of said material therebetween and across said anvil bearing surface, said knife blade being elongated and having a lengthwise dimension sufficient to bridge between said leg portions, said knife blade including a pair of surfaces converging to define a knife edge extending lengthwise of said knife blade, said carrier means supporting said knife blade for reciprocating movements along said path of travel and positioning one of the converging surfaces of said knife blade for surface-to-surface bearing engagement with said anvil bearing surface in a direction extending from adjacent free ends of said leg portions towards said connecting portion, whereby to reduce to chip form said fiber material fed across said anvil bearing surface, and means are provided for controlling the length of the chips being formed.

* * * * *

UNITED STATES PATENT AND TRADEMARK OFFICE

CERTIFICATE OF CORRECTION

PATENT NO. : 4,135,563

DATED : January 23, 1979

INVENTOR(S) : Walter H. Maucher

It is certified that error appears in the above-identified patent and that said Letters Patent are hereby corrected as shown below:

Col. 3, line 53 - "withdraw" should be --- withdrawn ---.

Col. 4, line 24 - "means" should be --- meant ---.

Col. 5, line 23 - "where" should be --- wherein ---.

Col. 5, line 25 - The second occurrence of "by" should be --- of ---.

Col. 5, line 51 - After "having" - "a" should be deleted.

Col. 7, line 56 - "slos" should be --- slots ---.

Col. 9, line 43 - "assemby" should be --- assembly ---.

Col. 11, line 17 - "plte" should be --- plate ---.

Col. 11, line 19 - "154" should be --- 254 ---.

Col. 11, line 52 - "and" should be --- end ---.

Col. 12, line 4 - "operating" should be --- operation ---.

UNITED STATES PATENT AND TRADEMARK OFFICE

CERTIFICATE OF CORRECTION

PATENT NO. : 4,135,563

DATED : January 23, 1979

INVENTOR(S) : Walter H. Maucher

It is certified that error appears in the above-identified patent and that said Letters Patent are hereby corrected as shown below:

Claim 6 - "approximtly" should be --- approximately ---.

Claim 32, line 45 - "above" should be --- about ---.

Claim 38, line 58 - "above" should be --- about ---.

Claim 41, line 10 - "alternatively" should be --- alternately ---.

Claim 46, line 54 - "actue" should be --- acute ---.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*